US009707418B2

(12) United States Patent
Henf et al.

(10) Patent No.: US 9,707,418 B2
(45) **Date of Patent: *Jul. 18, 2017**

(54) RESPIRATOR

(75) Inventors: Dirk Henf, Travemünde (DE); Christian Wilhelm, Lübeck (DE)

(73) Assignee: Dräger Safety AG & Co. KGaA, Lübeck (DE)

( * ) Notice: Subject to any disclaimer, the term of this patent is extended or adjusted under 35 U.S.C. 154(b) by 1372 days.

This patent is subject to a terminal disclaimer.

(21) Appl. No.: 13/552,737

(22) Filed: Jul. 19, 2012

(65) Prior Publication Data

US 2012/0279958 A1 Nov. 8, 2012

Related U.S. Application Data

(62) Division of application No. 11/955,590, filed on Dec. 13, 2007, now Pat. No. 8,251,244.

(30) Foreign Application Priority Data

Dec. 15, 2006 (DE) ..... 10 2006 059 339
Aug. 16, 2007 (DE) ..... 10 2007 038 598

(51) Int. Cl.
*B65D 45/34* (2006.01)
*A62B 9/04* (2006.01)
*B65D 63/06* (2006.01)

(52) U.S. Cl.
CPC ..... *A62B 9/04* (2013.01); *B65D 63/06* (2013.01); *Y10T 24/4077* (2015.01)

(58) Field of Classification Search
CPC ..... B65D 63/06; A62B 9/04; Y10T 24/4077
USPC ..... 220/212, 320, 321; 292/32, 35; 128/201.25, 205.27, 205.28, 205.29, 128/206.16, 206.17; 24/198, 199, 200, 24/193
See application file for complete search history.

(56) References Cited

U.S. PATENT DOCUMENTS 3,065,513 A * 11/1962 Warner ..... B64D 17/32 24/265 AL
3,206,816 A * 9/1965 Vilcins ..... A44B 11/02 24/200
3,296,672 A * 1/1967 Knight ..... A44B 11/06 2/300
3,914,831 A * 10/1975 Steinberg ..... A45C 13/26 24/265 AL
3,969,792 A * 7/1976 Hattori ..... A44B 11/02 24/17 B
4,117,573 A * 10/1978 Nakamura ..... A44B 11/02 24/200

(Continued)

*Primary Examiner* — Jacob K Ackun
*Assistant Examiner* — Jenine Pagan
(74) *Attorney, Agent, or Firm* — McGlew and Tuttle, P.C.

(57) ABSTRACT

A closing device is provided for a container of a respirator with two container shells (2, 2') joining each other at front surfaces, with at least one tightening strap (4), which encloses a part of a container shell outer surface located at right angles to the front surfaces. Two holding elements (5, 5') are each provided with a recess (6, 6') and are formed at the free ends of the tightening strap (4). A closing element (7) is formed in a U-shaped pattern with two legs (8) and meshes with each recess (6, 6') of the holding elements (5, 5'). The legs (8) of the closing element (7) can be pulled out of the recess (6, 6') of the holding elements (5, 5') to take off the tightening strap (4).

1 Claim, 4 Drawing Sheets

(56) References Cited

U.S. PATENT DOCUMENTS

| | | | | | |
|---|---|---|---|---|---|
| 4,400,855 | A | * | 8/1983 | Stuart | B65D 63/16<br>24/200 |
| 4,784,286 | A | * | 11/1988 | Dahrendorf | A62B 25/00<br>220/315 |

* cited by examiner

RESPIRATOR

CROSS REFERENCE TO RELATED APPLICATIONS

This application is a divisional under 37 CFR 1.53(b) of pending prior application Ser. No. 11/955,590 filed Dec. 13, 2007, now U.S. Pat. No. 8,251,244 which claims the priority of German Patent Application DE 10 2006 059 339.1 filed Dec. 15, 2006 and German Patent Application DE 10 2007 038 598.8 filed Aug. 16, 2007. The entire contents of each application is hereby incorporated by reference in its entirety.

FIELD OF THE INVENTION

The present invention relates to a respirator with at least two container shells joining each other at front surfaces and with a closing device for holding together the container shells.

BACKGROUND OF THE INVENTION

A respirator with a closing device for closing a stand-by container composed of two identical container shells, in which the shells are held together by tightening straps arranged in a star-shaped pattern, is known from DE 36 39 421 C2. The closing device proposed has a very complicated design to attain a constant pressing pressure on a sealing ring lying between the front surfaces of the container shells.

A respirator of the type, in which dogs arranged at the ends of a tightening strap are held together by a lever, wherein the dogs snap into corresponding windows at the lever, is known from DE 42 39 766 C2 (see also corresponding U.S. Pat. No. 5,450,844 hereby incorporated by reference). Even though such a closure is satisfactory in terms of the sealing function, its mechanical design is highly complicated and its manufacture is expensive.

A respirator, comprising two container shells, is known from DE 199 42 850 C1 (see also corresponding U.S. Pat. No. 6,415,786 hereby incorporated by reference), wherein one container shell is provided with a strap mounted in two opposite fulcrum points and the strap is provided with a lever, which is used to open the two container shells. The closing device is especially suitable for containers that are mounted on a wall and which remain on the wall when the respirators are removed. Such closing devices are not optimally suitable for containers that are intended for mobile use.

SUMMARY OF THE INVENTION

The basic object of the present invention is to improve a respirator of the type such that the containers to be closed are well suited for mobile use and easy opening of the containers is made possible at the same time.

This object is accomplished according to the present invention by a respirator with at least two container shells joining each other at front surfaces and a closing device for holding together the container shells with at least one tightening strap, which encloses a part of a container shell outer surface located at right angles to the front surfaces, two holding elements, which are provided with a recess each and are provided at the free ends of the at least one tightening strap, a closing element, which has a U-shaped design with two legs and meshes with each recess of the holding elements, wherein the legs of the closing element can be pulled out of the recess of the holding elements to take off the tightening strap.

The legs of the closing element are caused to mesh with the recesses of the holding elements in the closed state of the container shells. The container is opened by pulling the two legs out of the recesses of the holding elements.

An essential advantage of the present invention compared to the state of the art is that the respirator according to the present invention is well suited for mobile use because of the small overall size of the closing device and that opening takes place with the application of a relatively weak force by pulling the closing element out of the recesses of the holding elements.

Another advantage achieved with the present invention is that the respirator according to the present invention and especially the closing device can be manufactured in a very cost-effective manner.

The respirator according to the present invention is preferably designed such that the two holding elements are designed as a loop each of the particular free ends of the at least one tightening strap.

The closing device of the respirator according to the present invention may have, furthermore, holding elements, which all have a one-part design, wherein the recess of the holding elements is tubular. The legs of the closing element are of a cylindrical shape. It is useful to provide the recess of the holding elements conically with an angle of preferably 1.15°, so that the two parallel legs can be easily removed from the recesses of the holding elements.

The provision of a holding device on the respirator according to the present invention of another preferred embodiment facilitates the holding of the closing device. The legs of the closing element are preferably dimensioned such that they project beyond the side edges of the recess formed in the holding elements when they mesh with the holding elements. The projecting part of the leg of the closing element can be fixed now by the holding device and secured by a lead seal.

In an especially preferred embodiment of the respirator according to the present invention, a closing cover is provided, which is connected to the closing element and is provided with a grip. The legs of the closing element are pulled out of the recess of the holding elements during the opening of the closing cover. The direction of opening of the closing cover extends in this case at right angles to the plane of the at least one tightening strap. The closing device of the container can thus be unlocked in a simple manner with both the left hand and the right hand in the hip area of a carrying person in case of mobile use.

The present invention will be explained in more detail with reference to the attached drawings, where identical structures are designated by the same reference numbers. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
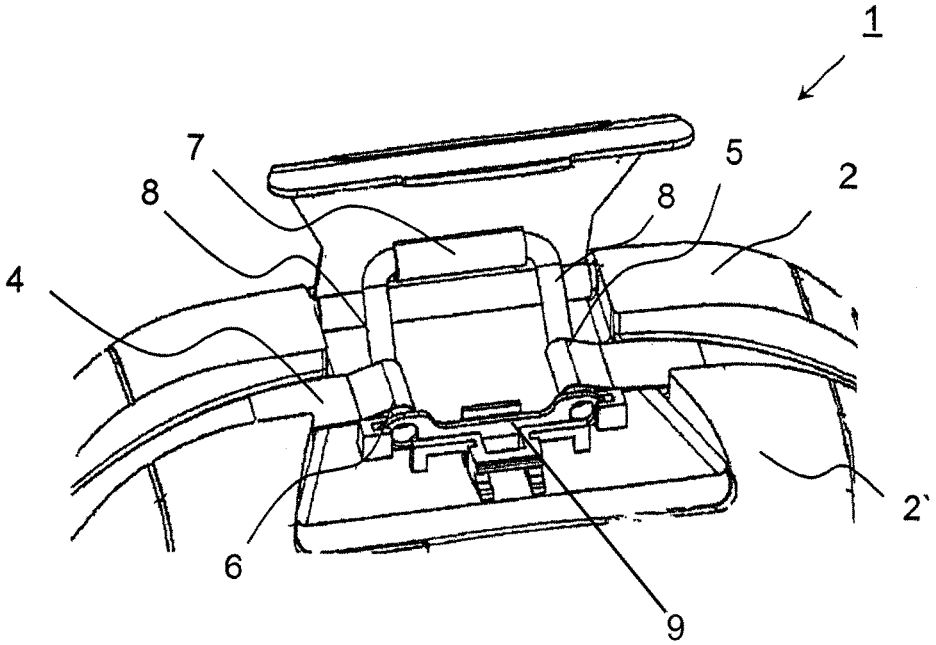
FIG. 1 is a perspective view showing a first embodiment of a closing device of the respirator according to the present invention in a nearly closed state.

Referring to the drawings in particular FIG. 1 shows a simplified view of a first embodiment of a closing device 1 of the respirator according to the present invention in a nearly closed state. The closing device 1 comprises a tightening strap 4 and two holding elements 5. The holding elements 5 are each designed as a loop at the free ends of the tightening strap 4 and thus form a recess 6. In addition, the closing device 1 comprises a closing element 7, which has a U-shaped design and has two legs 8.

The legs 8 of the closing element 7 are of a cylindrical shape and can be caused to mesh with the respective recesses 6 of the holding elements 5. In the view according to FIG. 1, the legs 8 of the closing element 7 are bent towards one another at an angle of 1.5°. This design makes possible a better fixation of the legs 8 of the closing element 7 in the particular recesses 6 of the holding elements 5. However, the legs 8 of the closing element 7 may also be parallel to one another (not shown) in another embodiment. The closing device 1 of the respirator according to the present invention as shown in FIG. 1 is shown in a nearly closed state. The legs 8 of the closing element 7 are caused to mesh with the recess 6 of the holding elements 5. The closing device 1 is opened by pulling the two legs 8 out of the recess 6 of the holding elements 5.

Figure 2:
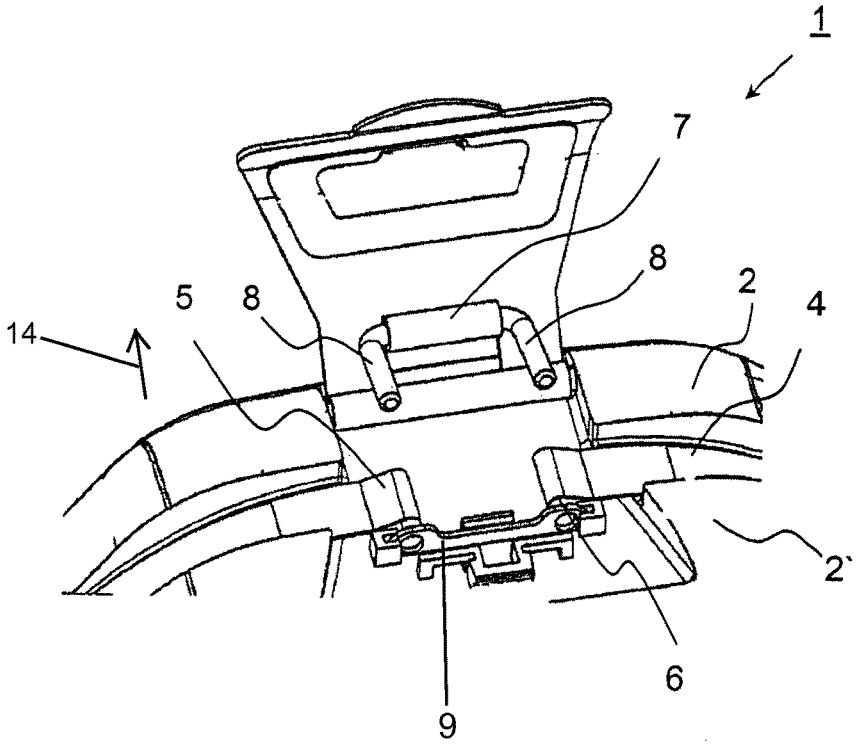
FIG. 2 is a perspective view showing the closing device of the respirator according to the present invention as shown in FIG. 1 in an opened state.

An opened state of the closing device 1 without tightening strap 4 is shown in FIG. 2.

Figure 3:
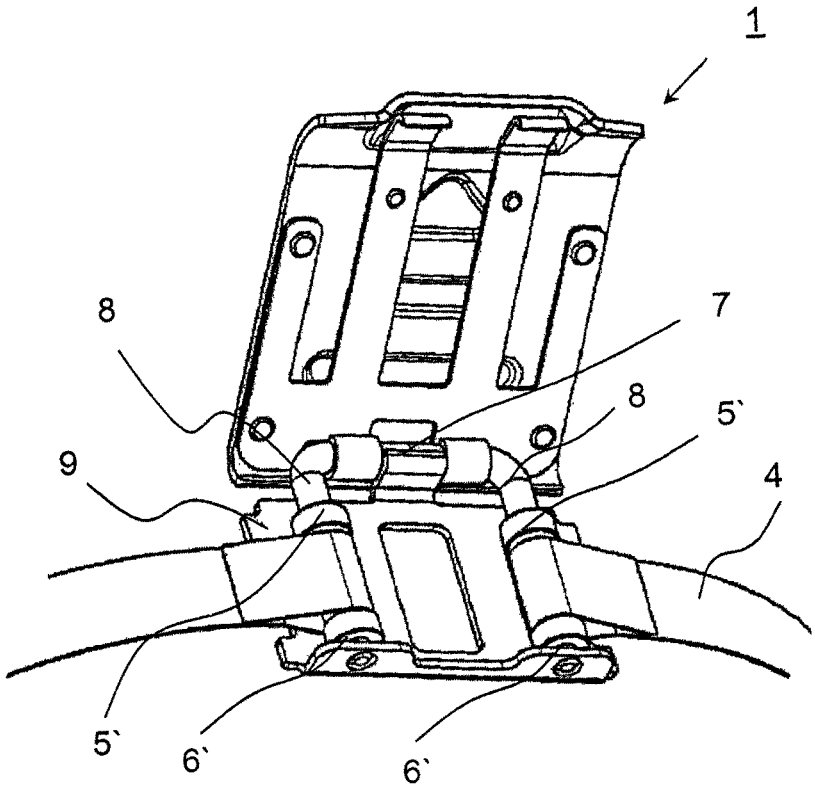
FIG. 3 is a perspective view showing a second embodiment of a closing device of the respirator according to the present invention in a nearly closed state.
Figure 6:
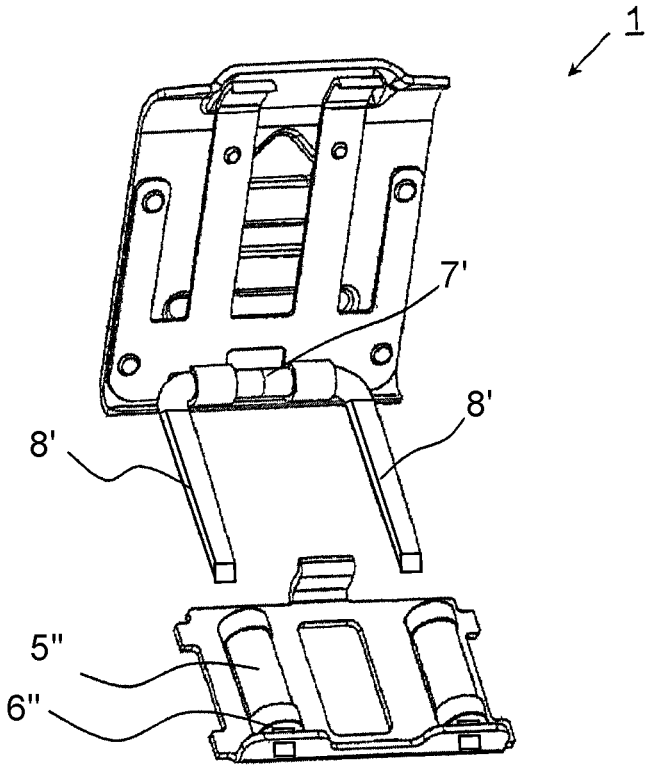
FIG. 6 is a perspective view of another embodiment of the legs of a closing device.

FIG. 3 shows a second embodiment of the closing device 1 of the respirator according to the present invention in a nearly closed state. The closing device 1 comprises a tightening strap 4 and two holding elements 5' of a one-part design with a recess 6' each, wherein the holding elements 5' are provided at the free ends of the tightening strap 4. The ends of the tightening strap 4 advantageously surround the holding elements 5'. The recess 6' of the holding elements 5' is tubular. The closing device 1 comprises, furthermore, a closing element 7, which has a U-shaped design and has two legs 8. The legs 8 of the closing element 7 are of a cylindrical design complementary to the holding elements 5'. In another advantageous embodiment, the recess 6' of the holding elements 5' may be of a conical design, with a cone angle in the range of 1° to 2°. A cone angle of 1.15° is preferably selected. The legs 8 of the closing element 7 have, furthermore, a structure complementary to the recess 6' of the holding elements 5'. In still another advantageous embodiment, the first recess of the holding elements 5" is rectangular and the legs 8' of the closing element 7' are a cuboid, as shown in FIG. 6. In the nearly closed state of the closing device 1 of the respirator according to the present invention as shown in FIG. 3, the closing element 7 is caused to mesh with each recess 6' of the holding elements 5'. The closing device 1 is opened in the same manner as in the case of the closing device 1 shown in FIG. 1, which was mentioned above, namely, by pulling the two parallel legs 8 out of the recess 6' of the holding elements 5'.

Figure 4:
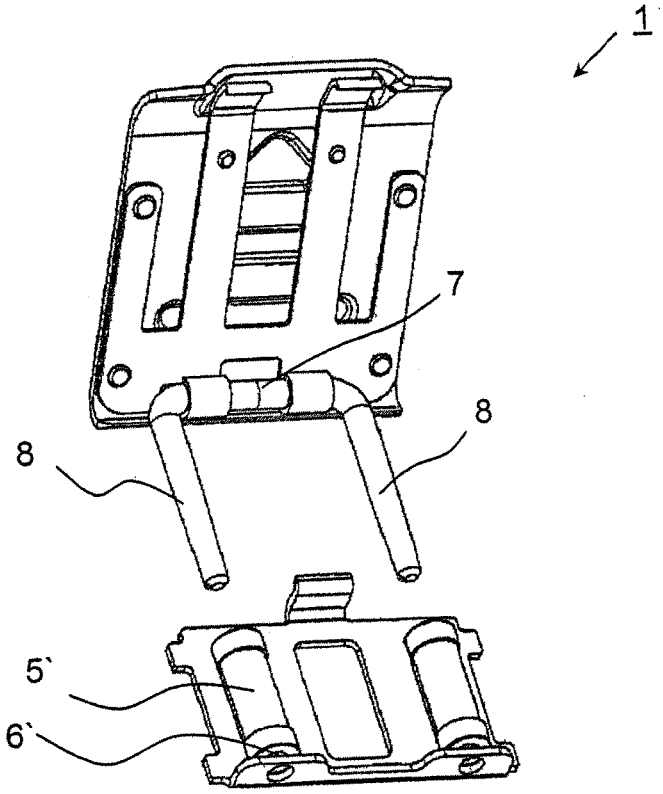
FIG. 4 is a perspective view showing a closing device of the respirator according to the present invention as shown in FIG. 3 in an opened state without tightening strap.

An opened state of the closing device 1 of the respirator according to the present invention as shown in FIG. 3 is shown in FIG. 4.

Figure 5:
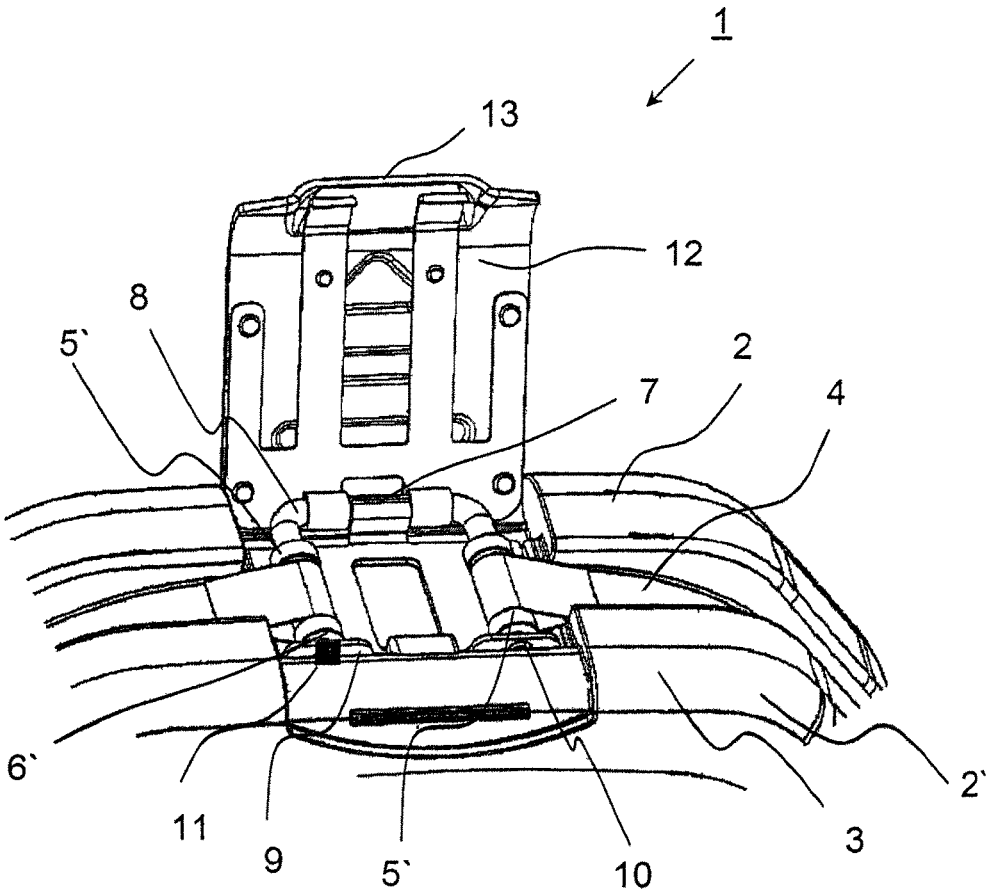
FIG. 5 is a perspective view showing the respirator according to the present invention with the closing device according to FIG. 3 in a nearly closed state.

FIG. 5 shows the respirator according to the present invention with the closing device 1 shown in FIG. 3 for the gas-tight closing of two container shells 2, 2' joining each other at front surfaces in a nearly closed state. Furthermore, a container 3 is shown, which is formed from the two container shells 2, 2' joining each other at front surfaces. The container shells 2, 2' are held together and closed with a tightening strap 4. In the tightened state, the tightening strap 4 encloses part of a container shell outer surface located at right angles to the front surfaces of the container shells 2, 2'. The container 3 of the respirator according to the present invention is used for the gas-tight closure of a respirator with a moisture-sensitive chemical oxygen carrier, which is used especially in the area of underground mining in order to make possible the reliable breathing of the user of the device in a toxic environment in case of an emergency.

The closing device 1 of the respirator according to the present invention is fixed by a holding device 9 in all five views in FIGS. 1 through 5. The holding device 9 is preferably rectangular in shape, so that it can be connected with a first angle side to the container shell 2 or 2'. Recesses 10, which are intended to receive and fix the legs 8 of the closing element 7, are formed in the second angle side of the lever device 9. The legs 8 of the closing element 7 are therefore dimensioned such that they project beyond the side edges of the recess 6, 6' formed in the holding elements 5, 5'. A lead seal 11, which is shown in FIG. 5, is preferably provided at one of the two parts of the legs 8 of the closing element 7, which said part projects beyond the side wall of the recess 6, 6' formed in the holding elements 5, 5'. The closing device 1 of the respirator according to the present invention according to FIGS. 1 through 5 is provided, furthermore, with a closing cover 12, which is connected to the closing element 7. The closing cover 12 is provided, moreover, with a grip 13. When opening the closing cover 12, the legs 8 of the closing element 7 are pulled out of the recesses 6, 6' of the holding elements 5, 5'. The direction of opening 14 of the closing cover 12 extends at right angles to the plane of the tightening strap 4. The grip 13 preferably has a large surface, so that easy opening of the closing cover 12 with protective gloves is guaranteed in emergency situations. The respirator is kept ready in the container 3 of the respirator according to the present invention by pressing together the container shells 2, 2' by means of an auxiliary device and by strapping the tightening strap 4 around part of a container shell outer surface located at right angles to the front surfaces. The holding elements 5, 5' provided at the free ends of the tightening strap 4 are caused to mesh with the legs 8 of the U-shaped closing element 7 by introducing the legs 8 into the recess 6, 6' of the holding elements 5, 5'. The closing cover 12 closes the closing device 1 in this position. The closing device 1 is fixed by the holding device 9. It is guaranteed by a locking mechanism on the closing cover 12 that the closing device 1 will not open under load (not shown).

While specific embodiments of the invention have been shown and described in detail to illustrate the application of the principles of the invention, it will be understood that the invention may be embodied otherwise without departing from such principles.

What is claimed is:

1. A respirator comprising:

two container shells joining each other at front surfaces;

a closing device for holding together said container shells, said closing device comprising:

a tightening strap enclosing part of a container shell outer surface located at right angles to the front surfaces;

a first holding element provided with a first recess and formed at a first free end of said tightening strap;

a second holding element provided with a second recess and formed at a second free end of said tightening strap;

a U-shaped closing element with a first leg and with a second leg, said first leg engaging said first recess of said first holding element and said second leg engaging said second recess of said second holding element, wherein said first leg and second leg of said closing element can be pulled out of said recesses of said first holding element and said second holding element to take off said tightening strap;

a holding device for holding said closing device, said holding device forming a right angle with a first side portion of the right angle connected to a container shell and a second side portion of the right angle having holding device recesses respectively engaged by said legs and projecting beyond side edges of said first recess and said second recess of said holding elements, whereby said closing element is fixed within said holding device recesses.

* * * * *